United States Patent [19]

Carpenter

[11] 4,142,121

[45] Feb. 27, 1979

[54] ELECTRICAL IGNITERS

[75] Inventor: Frederick C. Carpenter, Cheltenham, England

[73] Assignee: Smiths Industries Limited, London, England

[21] Appl. No.: 855,108

[22] Filed: Nov. 25, 1977

Related U.S. Application Data

[63] Continuation-in-part of Ser. No. 718,704, Aug. 20, 1976, abandoned.

[30] Foreign Application Priority Data

Sep. 8, 1975 [GB] United Kingdom ..... 36919/75
Sep. 29, 1977 [GB] United Kingdom ..... 40542/77

[51] Int. Cl.[2] ..... H01T 13/52
[52] U.S. Cl. ..... 313/131 A; 313/131 R
[58] Field of Search ..... 313/131 A, 131 R, 130, 313/141; 123/169 E

[56] References Cited

U.S. PATENT DOCUMENTS

| | | | |
|---|---|---|---|
| 2,734,143 | 2/1956 | Laird | 313/131 A |
| 2,870,376 | 1/1959 | Tognola | 313/131 R |
| 2,981,860 | 4/1961 | Suter | 313/131 R |
| 2,988,663 | 6/1961 | Rademacher | 313/131 R |
| 3,014,151 | 12/1961 | Segall | 313/130 |
| 3,037,140 | 5/1962 | Schurecht | 313/131 A |
| 3,538,372 | 11/1970 | Terao | 313/131 R |
| 3,995,184 | 11/1976 | Insley | 313/131 A |

FOREIGN PATENT DOCUMENTS

| | | | |
|---|---|---|---|
| 724016 | 2/1955 | United Kingdom | 313/131 A |

*Primary Examiner*—John Kominski
*Attorney, Agent, or Firm*—Pollock, Vande Sande and Priddy

[57] ABSTRACT

A surface-discharge igniter for a gas-turbine engine has a pellet of rod shape a part at least of the pellet surface being semiconductive so that when voltage is applied between electrodes connected at either end of the pellet it causes electrical discharge along its length. The pellet may, in one arrangement, be mounted to be a tight fit within the central-section of a key-hole bore which extends axially through a ceramic block within the igniter's outer metal shell. A strip of the pellet surface is exposed along the radially-divergent section or discharge cavity of the bore and discharge along the strip generates a plasma flame within the cavity that bursts forth through an aperture in the bottom electrode at the tip of the shell. In another arrangement the rod-pellet is mounted at the end of a mineral-insulated cable, coaxially within a cylindrical cavity. The pellet may alternatively be mounted to extend transversely of the igniter and to be exposed along its length at the operative tip of the igniter. Discharge may occur over the whole of the pellet surface, but the active semiconductive surface may be limited to a longitudinal or helical strip.

13 Claims, 10 Drawing Figures

Fig.1.
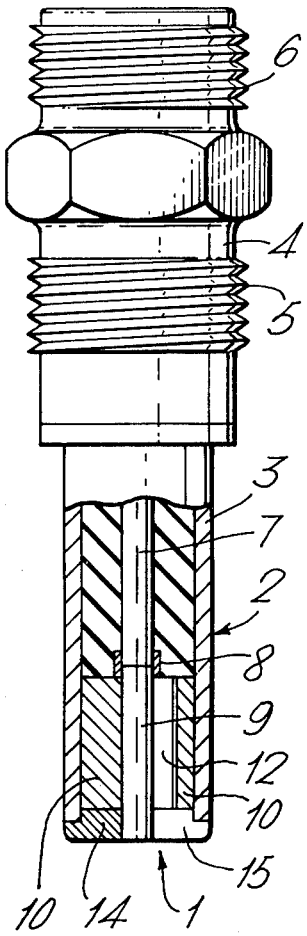
Fig.2.
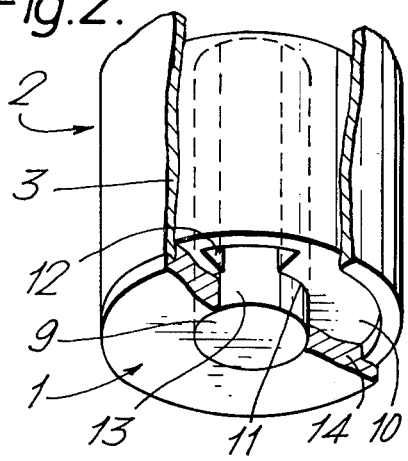
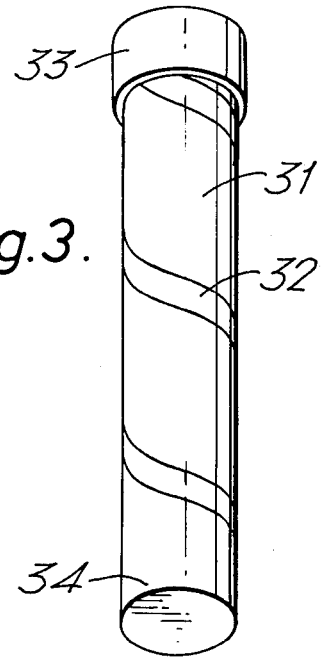
Fig.3.

ELECTRICAL IGNITERS

CROSS-REFERENCE TO RELATED APPLICATION

This application is a continuation-in-part of my prior copending application Ser. No. 718,704 filed Aug. 30, 1976, for Electrical Igniters, and now abandoned.

This invention relates to electrical igniters such as used, for example, for initiating and maintaining combustion in a gas-turbine engine.

The invention is concerned especially with electrical surface-discharge igniters in which two electrodes are separated from one another across a surface of semiconductive material within a cavity of the igniter. An igniter of this form is described in U.S. Pat. No. 2,870,376 of Tullio Tognola, issued Jan. 20, 1959, wherein part of the wall of the cavity is provided by the inner surface of a ring of semiconductive material that is interposed between two electrodes of the igniter so that voltage applied between these two electrodes causes discharge across the semiconductive, inner, surface of the ring.

It is an object of the present invention to provide an electrical surface-discharge igniter that avoids the need to provide the semiconductive material in ring-shape form.

It is another object to provide an electrical surface-discharge igniter which is of a construction that readily enables the discharge path across the semiconductive surface between the electrodes to be extended significantly in length.

According to the present invention there is provided an electrical igniter including two spaced electrodes, and a semiconductive surface formed by a part at least of the surface along the length of a rod-shape element and wherein said semiconductive surface extends between said electrodes to provide an electrical discharge path between said electrodes along the length of said semiconductive surface.

Construction of the rod-shape element or pellet of the present invention is more readily achieved than that of the ring-shape element of the earlier forms of igniter. The semiconductive surface may be the surface of a rod wholly of the semiconductive material, or alternatively may be provided by a surface layer of the appropriate semiconductive material. Furthermore, the semiconductive surface providing the discharge path between the electrodes may be limited to only a strip along, or along and around, the rod element. The provision of such a strip on the outside of the rod element is considerably simpler than would be the provision of such a strip on the inside of a ring-shape element.

The rod-shape element may be of a ferrite such as ferric oxide or a titanium or titanium zinc ferrite. Alternatively a mixture of copper oxide, chromium oxide and alumina, Nernst oxide (that is, primarily an oxide of zirconium containing small amounts of yttrium and thorium oxides) or Auer oxide (which contains oxides of cerium, lanthium, neodymium and praseodymium) may be used. In general it is envisaged that there are a large number of nonstoichiometric materials capable of withstanding high temperatures that may be used as the semiconductive material of the igniter.

Electrical igniters in accordance with the present invention and each for use in a gas-turbine engine, will now be described by way of example, with reference to the accompanying drawings, in which:

FIG. 1 is a part-sectional elevation of a first of the electrical igniters;

FIG. 2 is a perspective view of the tip of the electrical igniter of FIG. 1;

FIG. 3 illustrates a modified form of semiconductive element that may be used in the igniter of FIG. 1;

Figure 4:
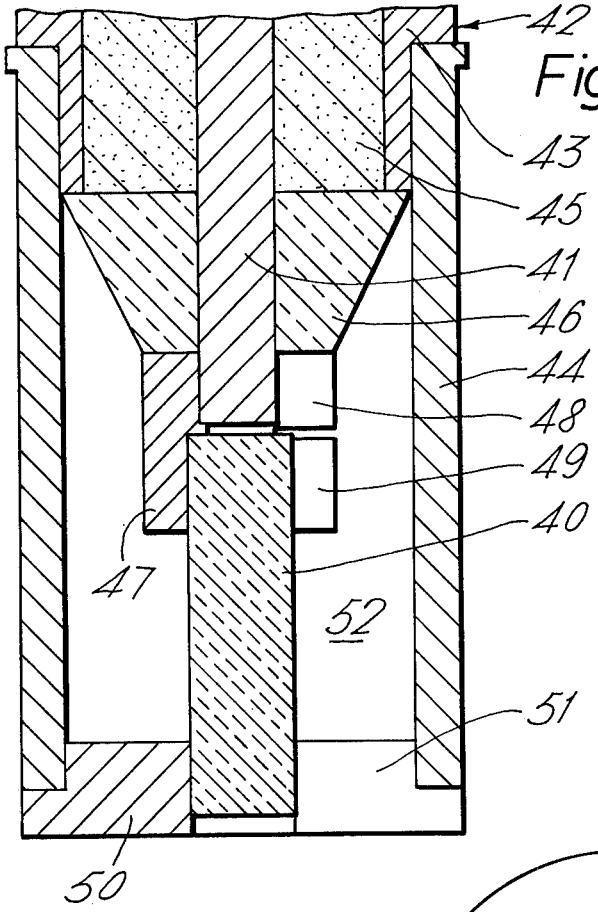
FIG. 4 is a longitudinal section of a second electrical igniter in accordance with the present invention.

Referring to FIGS. 1 and 2, the operative tip 1 of the igniter is located at one end of a substantially cylindrical nose 2 of a tubular metal shell 3 that provides the external surface of the igniter. The shell 3 above the nose 2 is of enlarged diameter to provide a head 4 having screw threads 5 for use in mounting the igniter in the gas-turbine engine with its nose 2 projecting into the combustion chamber.

Screw threads 6 are provided on the head 4 for engagement by an electrical connector (not shown) that serves to establish both an earth or ground connection with the shell 3, and an electrically "live" connection with a stainless-steel rod 7 internally of the head 4. The rod 7, which is electrically insulated from the shell 3, extends axially within the nose 2 and is connected electrically by means of a split-ring electrode 8 to the upper end of an elongate, rod-shape pellet 9 of electrically semiconductive material.

The pellet 9 extends from the rod 7 axially of the nose 2 within a cylindrical block 10 of ceramic material that fits tightly within the shell 3. The block 10 has a bore of key-hole cross-section extending throughout its length, and the pellet 9 is a tight fit within the central, circular section 11 of the bore so as to leave a cavity 12 of radially-divergent section extending along a strip 13 of the pellet surface within the block 10. Electrical connection is made to the lower end of the pellet 9 at the tip 1, by a disc-shape electrode 14 which is welded over the open end of the shell 3. The electrode 14 has a key-hole shape aperture 15 therein that corresponds to, and is aligned with, the bore through the block 10, so as to provide an opening for the discharge cavity 12.

Application of voltage (for example, 2kV) between the rod 7 and the shell 3 is effective to cause electric discharge to take place within the cavity 12 along the surface of the strip 13 of the pellet 9 between the spaced electrodes 8 and 14. This discharge creates a plasma flame that bursts forth through the aperture 15 to a substantial distance into the combustion chamber of the gas-turbine engine to ensure positive ignition of the fuel-air mixture therein.

The pellet 9 is formed of compacted ferric-oxide particles. The ferric-oxide particles are moulded to the rod form with a binder, and the moulding is then sintered by firing at about 1300° C. The outer, cylindrical, surface of the sintered moulding is then doped with titanium dioxide to enhance electrical surface-discharge over the surface. This doping is carried out by dipping the moulding in a dilute solution of titanium trichloride and refiring at about 1300° C. to convert the trichloride coating to titanium dioxide. The entire surface, apart from the strip 13, is then glazed to inhibit discharge over the areas to which the glaze is applied, while permitting discharge over the strip 13. Alternatively the glaze may be applied to the whole moulding after doping, and then removed from the strip 13 to expose the doped semiconductive surface thereunder.

The electrodes 8 and 14 are of nickel-chromium alloy. This alloy has an expansion coefficient similar to that of the semiconductive pellet 9 and has been found to be resistant to spark erosion. It is therefore effective to ensure that the electrodes 8 and 14 remain in satisfactory contact with the surface of the pellet 9 throughout periods of repeated discharge along that surface. In this respect also it has been found that an igniter constructed on the lines described above is capable of repeated operation to ignite a gas-turbine engine positively, in spite of the fact that the cavity 12 may be initially flooded with liquid fuel (kerosene) or water, or a mixture of both.

The surface-discharge path of the semiconductor pellet need not be along the shortest distance between the electrodes of the igniter. A pellet of rod shape in which the discharge path is helical, is in this respect illustrated in FIG. 3.

Referring to FIG. 3, the rod-shape pellet 31, again, is of titanium dioxide-doped ferric oxide e.g., of the type described in Shoobert UK Pat. No. 724,016, and is glazed throughout except for a helical strip 32 of its cylindrical surface extending between the ends 33 and 34 to which electrode connection is made. With this form of pellet 31 the igniter may include a ceramic body corresponding to the block 10 into which the pellet is a tight fit and provides a helical cavity corresponding to the strip 32; alternatively the pellet 31 may be mounted axially of a cylindrical cavity. Whichever is the case, the use of the helical strip of exposed surface enables a substantial increase in length of the discharge path to be readily achieved.

With the above-described method of doping the ferric-oxide pellet, the titanium dioxide is effective to only a shallow depth. The bulk resistivity in this case may be of the order 50 kohm-cm. A greater degree of doping to reduce the resistivity (down to perhaps some 5 ohm-cm) may be achieved by dipping the completed ferric-oxide moulding in the solution of titanium trichloride before sintering, that is to say, when the higher porosity enables the solution to permeate further, if not wholly into the body.

The construction of the igniter may be specially adapted to make use of techniques used with mineral-insulated cabling. More particularly the igniter may be constructed as illustrated in FIGS. 4 and 5.

Figure 5:
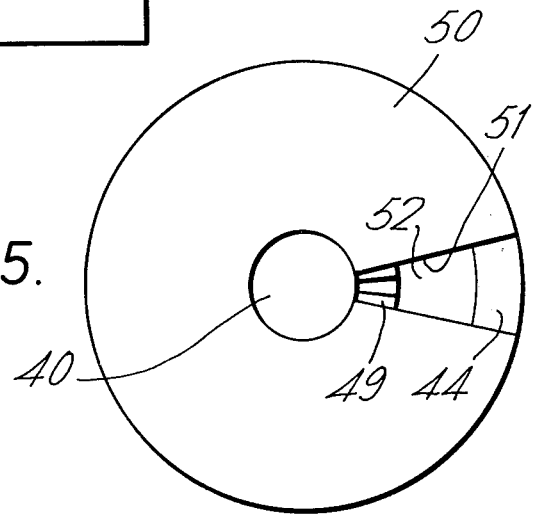
FIG. 5 is a plan view of the operative tip of the igniter of FIG. 4.

Referring to FIGS. 4 and 5, the rod-shaped ferrite pellet 40 in this case is connected to the central conducting core 41 of a mineral-insulated cable 42. The stainless-steel sheath 43 of the cable 42 is welded to the stainless-steel tubular shell 44 of the igniter and is insulated electrically from the core 41, which is also of stainless steel, by a mineral insulation 45 such as compacted magnesium-oxide powder. The core 41 projects beyond the sheath 43 into the shell 44 to extend through a conical separator 46, machined from a ceramic material, to establish electrical connection with one end of the pellet 40. Connection is established via a metal split-ring electrode 47 that has two spaced portions 48 and 49 that embrace the ends of the core 41 and pellet 40 respectively. Connection to the other end of the pellet 40 is established via an annular disc electrode 50 which is fixed within the end of the shell 44 and embraces the other end of the pellet 40. The disc electrode 50 has a small aperture 51 of sector shape that opens from the cavity 52 of the igniter.

The pellet 40 in the arrangement of FIGS. 4 and 5 may be glazed along its whole length apart from a longitudinal strip within the cavity 52 aligned with the aperture 51. Alternatively, a helical strip (corresponding to the strip 32 of the pellet 31 shown in FIG. 3) may be left unglazed, but clearly glazing may be omitted altogether so that the whole curved surface of the pellet 40 is available for discharge along the length of said pellet.

Figure 6:
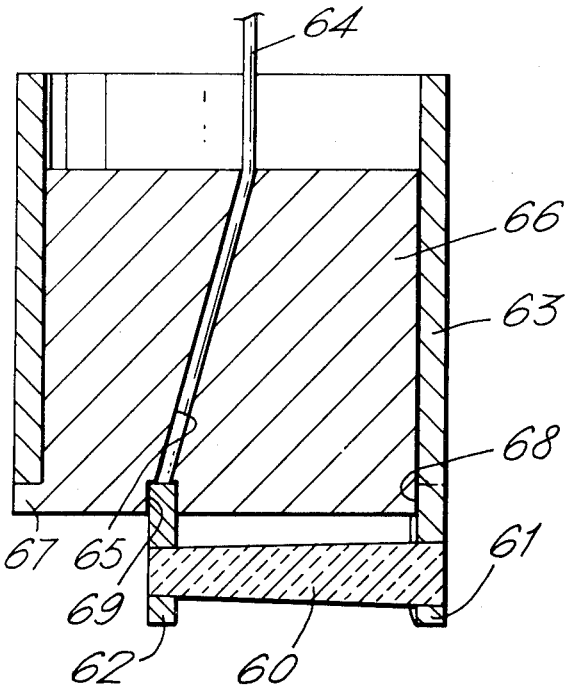
FIG. 6 is a longitudinal section of a third electrical igniter in accordance with the present invention.
Figure 8:
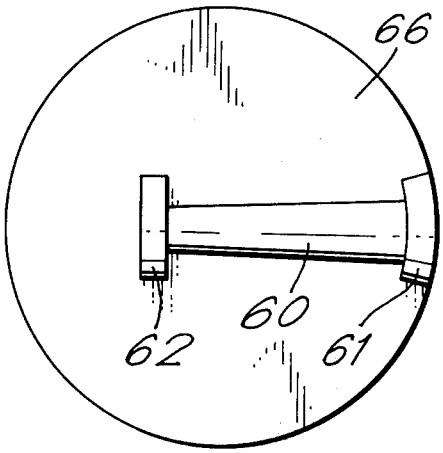
FIG. 8 is a plan view of the operative tip of the igniter of FIG. 6; and, FIGS. 9 and 10 are perspective views of the igniter of FIG. 6 with modified forms of semiconductive elements.
Figure 7:
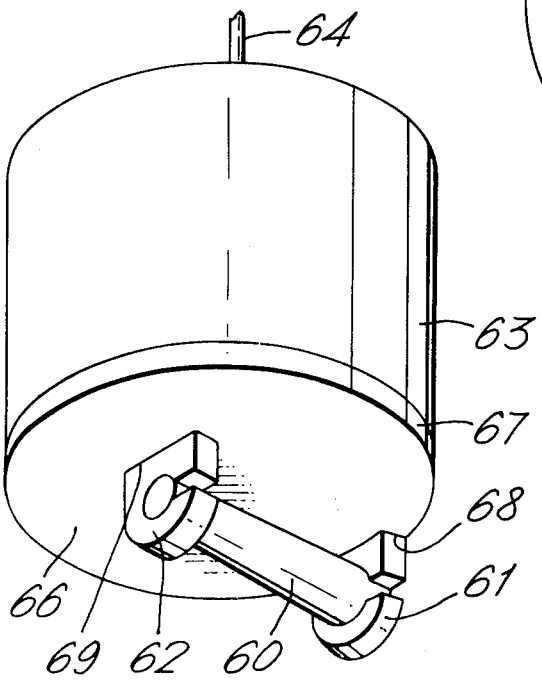
FIG. 7 is a perspective view of the igniter of FIG. 6.

Referring now to FIGS. 6 to 8, the rod-shape pellet 60 in this case is mounted transversely of the igniter at its operative tip. The pellet 60 is supported at each end by an outer and inner spring-clip electrode 61 and 62 respectively which each have an aperture therethrough within which the pellet 60 is firmly secured.

The pellet 60 has a circular cross-section and is tapered slightly along its length such that its inner end, that is, the end in contact with the inner electrode 62, is of a smaller diameter than its outer end, that is, the end in contact with the outer electrode 61. The apertures through the two electrodes are also suitably tapered, with the diameter of the aperture of the outer electrode 61 being greater than that of the inner electrode 62. In this manner, assembly of the igniter is facilitated since the pellet 60 can be pushed through the aperture in the outer electrode 61 and into the aperture in the inner electrode 62 without damaging its curved surface by rubbing against the edge of the aperture.

The outer spring-clip electrode 61 is formed as part of an outer cylindrical shell or ground electrode 63 of the igniter, and is of a nickel alloy.

The inner spring-clip electrode 62 is formed at one end of an elongate conductor element 64 and can also be a nickel alloy. The conductor element 64 extends at an angle to the length of the igniter through a hole 65 in an electrically-insulative insert 66 contained within its outer shell 63. The conductor element 64 emerges from the upper end of the igniter and serves to enable electrical connection to be made with the inner end of the pellet 60.

The insulative insert 66 is of alumina and is located in the shell 63 such as to project a short distance below its lower end. The lower end of the insert 66 has a flat end surface and a radially-extending flange 67 which abuts the lower end of the shell 63 and has its edge lying flush with the outer surface of the shell. The flange 67 has a slot 68 at its edge through which the outer electrode 61 projects. A recess 69 is similarly formed in the lower end surface of the insert 66 for reception of the inner electrode 62. The outer and inner electrodes 61 and 62 respectively each project below the lower surface of the insert 66 by a distance sufficient to ensure that the pellet 60 is spaced from the end surface of the insert.

The outer and inner electrodes 61 and 62 respectively may be provided with a coating of platinum to reduce wear caused by spark erosion. Alternatively, a collar of platinum, iridium or a platinum-rhodium alloy may be fitted in the aperture through each electrode, between it and the ends of the pellet 60.

The inner electrode 62 and the conductor element 64 can be secured with the insert 66 by filling the hole 65 through the insert with a glass seal or by means of brazing, in which case, the regions of the insert 66 in contact with the inner electrode, such as, the recess 69 are given a preliminary metal coating. Similarly, the insulative insert 66 can be secured within the outer shell 63 by means of a glass seal or by brazing.

The pellet 60 is therefore exposed along the major part of its length at the operative tip of the igniter. This arrangement effectively avoids any problems that might occur with the previously described igniters (in which the pellet is contained within a cavity), upon blockage of the cavity caused by, for example, fouling with combustion products.

Figure 9:
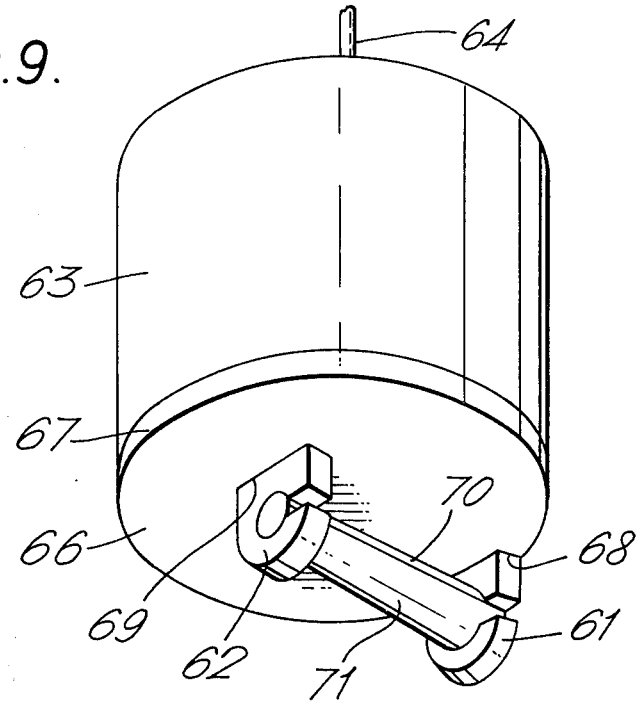
Figure 10:
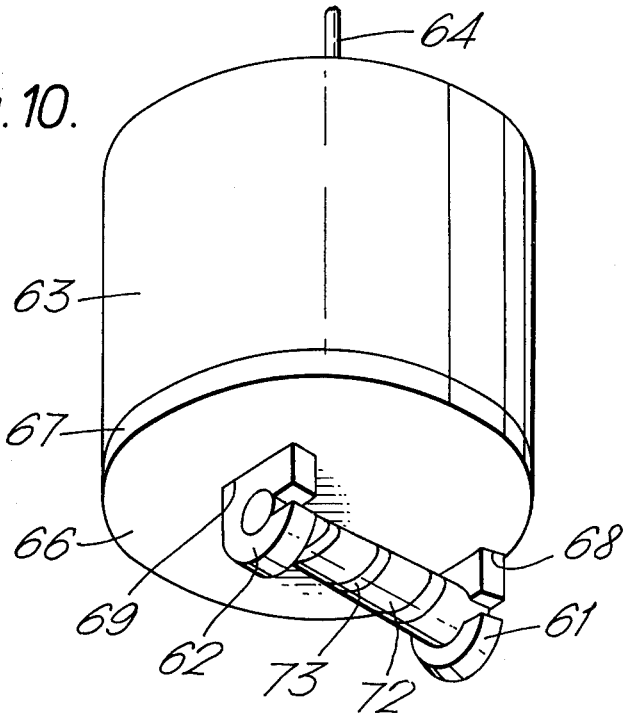

As in the previous arrangement, the pellet 60 may be coated over a part of its surface with a glaze so as to confine discharge to unglazed areas. In this way the discharge path can be confined to a straight or curved strip between the electrodes. It may be found desirable, as shown in FIG. 9, to form a glaze over the area 70 of a pellet 71 adjacent the lower surface of the insulative insert 66 so as thereby to inhibit discharge in the space between the pellet and the surface of the insert. The discharge path may alternatively be extended in the manner shown in FIG. 10 by glazing a pellet 72 such as to leave a path in the form of a helical strip 73 between the electrodes.

I claim:

1. An electrical igniter comprising first and second electrodes, said first and second electrodes being spaced from one another, a rod-shape element, means mounting said rod-shape element to extend between said first and second electrodes, at least a part of the surface along the length of said element being a semiconductive surface, said semiconductive surface providing an electrical discharge path between said electrodes along the length of said element.

2. An electrical igniter according to claim 1 wherein said igniter includes means defining a cavity which is open at one end, means mounting said first electrode adjacent said open end, means mounting said second electrode remote from said open end, at least a part of said semiconductive surface being exposed within said cavity.

3. An electrical igniter according to claim 2 including a block of electrically insulating material, said block having a bore extending therein, means mounting the rod-shape element to extend lengthwise within said bore, said rod-shape element occupying a first part only of the cross-section of the bore along its length and said cavity being defined by a second part of said cross-section of the bore.

4. An electrical igniter according to claim 2 wherein said cavity is cylindrical, the said rod-shape element being located axially of the said cavity.

5. An electrical igniter according to claim 1 including means mounting said element to extend transversely of said igniter, said element being exposed along at least a part of its length at one end of the said igniter.

6. An electrical igniter according to claim 5 wherein said igniter has a substantially flat end surface at said end, said igniter including means mounting said element to extend over said end surface and spaced therefrom.

7. An electrical igniter according to claim 5 wherein said semiconductive surface is provided by a longitudinal strip of said rod-shape element.

8. An electrical igniter according to claim 5 wherein said semiconductive surface is provided by a helical strip of said rod-shape element.

9. An electrical igniter according to claim 5 wherein the said rod-shape element is of a ferrite.

10. An electrical igniter according to claim 9 wherein the said semiconductive surface is a surface layer of said ferrite doped with titanium dioxide.

11. An electrical igniter comprising a block of ceramic material, said block having a bore extending therein, a rod-shape element mounted to extend lengthwise within said bore, first and second electrodes coupled at opposite ends of the rod-shape element, said rod-shape element occupying a first part only of the cross-section of the bore along its length, and a second part only of said cross-section defining a cavity within said igniter, said rod-shape element having at least a strip-surface of semiconductive material extending between the said first and second electrodes and exposed to said cavity to provide a path for electrical discharge within said cavity along the length of said strip-surface, and one of said electrodes having an aperture opening from said cavity to enable passage therethrough of plasma flame created by said electrical discharge within the cavity.

12. An electrical igniter comprising a metal shell defining a cylindrical cavity, a rod-shape element mounted axially within said cavity, first and second electrodes coupled at opposite ends of the rod-shape element, said rod-shape element having at least a strip-surface of semiconductive material extending between the said first and second electrodes within said cavity to provide a path for electrical discharge within said cavity along the length of said strip surface, and one of said electrodes having an aperture opening from said cavity to enable passage therethrough of plasma flame created by said electrical discharge within the cavity.

13. An electrical igniter comprising a metal shell, an insulating insert located within said shell, said insert having a substantially flat end surface located at one end of said igniter, a first electrode, said first electrode being formed with said shell at said one end, a second electrode, means mounting said second electrode with said insert at said one end and spaced from said first electrode, a rod-shape element, and means mounting said element to extend between said first and second electrodes transversely of the igniter and spaced from said end surface, at least a part of the surface of said element being a semi-conductive surface which provides an electrical discharge path between said first and second electrodes along the length of said element.

* * * * *